US011241769B2

(12) United States Patent
Ishikawa et al.

(10) Patent No.: US 11,241,769 B2
(45) Date of Patent: Feb. 8, 2022

(54) METHODS AND APPARATUS FOR PROFILE AND SURFACE PREPARATION OF RETAINING RINGS UTILIZED IN CHEMICAL MECHANICAL POLISHING PROCESSES

(71) Applicant: Applied Materials, Inc., Santa Clara, CA (US)

(72) Inventors: David Masayuki Ishikawa, Mountain View, CA (US); Jeonghoon Oh, Saratoga, CA (US); Garrett Ho Yee Sin, San Jose, CA (US); Charles C. Garretson, Sunnyvale, CA (US); Huanbo Zhang, San Jose, CA (US); Chia-Ling Pai, Santa Clara, CA (US); Niraj Prasad, Sunnyvale, CA (US); Julio David Muzquiz, Austin, TX (US)

(73) Assignee: Applied Materials, Inc., Santa Clara, CA (US)

( * ) Notice: Subject to any disclaimer, the term of this patent is extended or adjusted under 35 U.S.C. 154(b) by 384 days.

(21) Appl. No.: 16/210,859

(22) Filed: Dec. 5, 2018

(65) Prior Publication Data

US 2019/0105754 A1 Apr. 11, 2019

Related U.S. Application Data

(63) Continuation of application No. 14/879,526, filed on Oct. 9, 2015, now Pat. No. 10,252,397.

(Continued)

(51) Int. Cl.

| | |
|---|---|
| ***B24B 37/32*** | (2012.01) |
| ***B24B 37/10*** | (2012.01) |
| ***B24B 57/02*** | (2006.01) |

(52) U.S. Cl.

CPC ..... *B24B 37/32* (2013.01); *B24B 37/105* (2013.01); *B24B 57/02* (2013.01)

(58) Field of Classification Search

CPC ..... B24B 37/20; B24B 37/30; B24B 37/105

(Continued)

(56) References Cited

U.S. PATENT DOCUMENTS 5,679,065 A * 10/1997 Henderson ..... B24B 37/32 451/287
6,001,007 A * 12/1999 Maeda ..... B24B 41/061 451/288

(Continued)

FOREIGN PATENT DOCUMENTS

CN 1910012 A 2/2007
JP 06181186 A 6/1994

(Continued)

OTHER PUBLICATIONS

Chinese Office Action dated Apr. 3, 2019 for Application No. 201510717954.9.

(Continued)

*Primary Examiner* — Orlando E Aviles
*Assistant Examiner* — Robert F Neibaur
(74) *Attorney, Agent, or Firm* — Patterson + Sheridan, LLP

(57) ABSTRACT

A retaining ring for a polishing process is disclosed. The retaining ring includes a body comprising an upper portion and a lower portion, and a sacrificial surface disposed on the lower portion, the sacrificial surface comprising a negative tapered surface having a taper height that is about 0.0003 inches to about 0.00015 inches.

15 Claims, 8 Drawing Sheets

FIG. 5

Related U.S. Application Data

(60) Provisional application No. 62/072,659, filed on Oct. 30, 2014.

(58) Field of Classification Search
USPC ..... 451/41, 285, 286, 287, 288, 398
See application file for complete search history.

(56) References Cited

U.S. PATENT DOCUMENTS

| | | | | |
|---|---|---|---|---|
| 6,116,992 | A * | 9/2000 | Prince | B24B 37/32 156/345.14 |
| 6,224,472 | B1 | 5/2001 | Lai et al. | |
| 6,251,215 | B1 * | 6/2001 | Zuniga | B24B 37/30 156/345.14 |
| 6,840,845 | B2 * | 1/2005 | Numoto | B24B 37/32 451/285 |
| 7,344,434 | B2 | 3/2008 | Chen et al. | |
| 7,485,028 | B2 | 2/2009 | Wilkinson et al. | |
| 7,608,173 | B2 | 10/2009 | Manens et al. | |
| 7,622,016 | B2 | 11/2009 | Lee | |
| 7,789,736 | B2 * | 9/2010 | Van Der Veen | B24B 37/32 451/285 |
| 8,388,412 | B2 | 3/2013 | Prabhu et al. | |
| 9,067,295 | B2 | 6/2015 | Deshpande et al. | |
| 2002/0173242 | A1 | 11/2002 | Wang et al. | |
| 2004/0040656 | A1 | 3/2004 | Hengel et al. | |
| 2007/0034335 | A1 | 2/2007 | Lee | |
| 2007/0298693 | A1 | 12/2007 | Ichinoshime | |
| 2009/0221223 | A1 | 9/2009 | Zuniga et al. | |
| 2013/0001899 | A1 | 1/2013 | Hwang et al. | |
| 2014/0170938 | A1 * | 6/2014 | Duescher | B24B 37/32 451/41 |
| 2015/0183077 | A1 | 7/2015 | Kim et al. | |

FOREIGN PATENT DOCUMENTS

| | | | |
|---|---|---|---|
| JP | 2012142413 | A | 7/2012 |
| JP | 2013056416 | A | 3/2013 |
| JP | 2016187056 | A | 10/2016 |
| KR | 101132632 | B1 | 4/2012 |
| TW | 200526353 | A | 8/2005 |

OTHER PUBLICATIONS

Japanese Office Action for Application No. JP 2015-213710 dated Aug. 22, 2019.
Taiwanese Office Action for Application No. TW 104135813 dated Jul. 3, 2019.
Taiwanese Office Action for Application No. TW 104135813 dated Nov. 21, 2019.
Chinese Office Action for Application No. 20151017954.9 dated Sep. 28, 2018.
Chinese Office Action in related application CN201911281460.5 dated Feb. 20, 2021.
International Search Report and Written Opinion in related application PCT/US2020/065708 dated Apr. 21, 2021.
Chinese Office Action issued to Application No. 201911281460.5 dated Jul. 16, 2021.

* cited by examiner

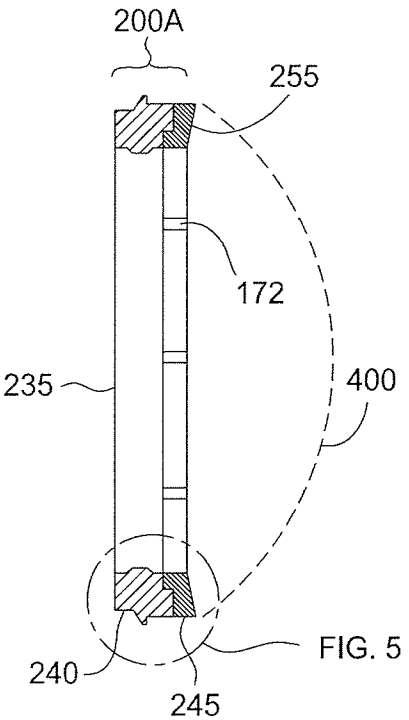
FIG. 5
FIG. 4
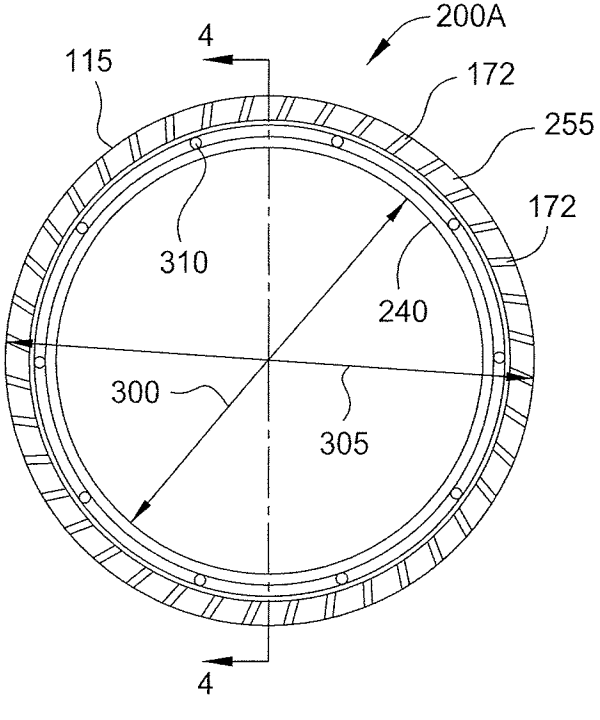
FIG. 3

METHODS AND APPARATUS FOR PROFILE AND SURFACE PREPARATION OF RETAINING RINGS UTILIZED IN CHEMICAL MECHANICAL POLISHING PROCESSES

CROSS-REFERENCE TO RELATED APPLICATIONS

This application is a continuation of U.S. patent application Ser. No. 14/879,526, filed Oct. 9, 2015, which application claims benefit of U.S. Provisional Patent Application Ser. No. 62/072,659 filed Oct. 30, 2014, each of which is hereby incorporated by reference herein.

FIELD

Embodiments of the disclosure relate to polishing systems for polishing a substrate, such as a semiconductor substrate. More particularly, embodiments relate to a retaining ring usable in a chemical mechanical planarization (CMP) system.

BACKGROUND

Chemical mechanical polishing (CMP) is a process commonly used in the manufacture of high-density integrated circuits to planarize or polish a layer of material deposited on a substrate. A carrier head may provide the substrate retained therein to a polishing station of the CMP system and controllably urge the substrate against a moving polishing pad. CMP is effectively employed by providing contact between a feature side of the substrate and moving the substrate relative to the polishing pad while in the presence of a polishing fluid. Material is removed from the feature side of the substrate that is in contact with the polishing surface through a combination of chemical and mechanical activity. Particles removed from a substrate while polishing become suspended in the polishing fluid. The suspended particles are removed while polishing the substrate by the polishing fluid.

The carrier head typically includes a retaining ring that circumscribes the substrate and may facilitate holding of the substrate in the carrier head. A bottom surface of the retaining ring is typically made of a sacrificial plastic material that is generally in contact with the polishing pad during polishing. The sacrificial plastic material is designed to progressively wear over sequential runs.

The retaining rings are typically manufactured using conventional CNC machining methods. However, the surface of the sacrificial plastic material produced by conventional machining methods is typically too rough and must be conditioned to produce a smoother surface and an acceptable flatness. One method for "break in" conditioning of a new retaining ring involves installing the retaining ring on a fully functional CMP system and running a recipe with numerous dummy wafers. However, this approach is inefficient due to high capital and labor costs.

Therefore, there is a need for a simplified method and apparatus for producing retaining rings having a desired roughness and surface flatness.

SUMMARY

A retaining ring, a retaining ring conditioning method, and a conditioning fixture are disclosed. In one embodiment, a fixture for forming a sacrificial surface on a retaining ring includes a fixture plate sized to substantially match an outside diameter of the retaining ring, and a clamp device adapted to provide a lateral load to one of an inside diameter sidewall or an outer diameter sidewall of a lower portion of the retaining ring.

In another embodiment, a retaining ring for a polishing process is disclosed. The retaining ring includes a body comprising an upper portion and a lower portion, and a sacrificial surface disposed on the lower portion, the sacrificial surface comprising a negative tapered surface having a taper height that is about 0.0003 inches to about 0.00015 inches.

In another embodiment, a retaining ring for a polishing process is disclosed. The retaining ring includes a ring shaped body comprising an upper portion and a lower portion, the upper portion having a planar surface disposed in a first plane, and a sacrificial surface disposed on the lower portion, the sacrificial surface disposed in a second plane that is negatively angled relative to first plane and having a taper height that is about 0.0003 inches to about 0.00015 inches.

In another embodiment, a method for forming a retaining ring for a polishing process is provided. The method includes coupling a fixture plate to an upper portion of a ring-shaped body, providing a lateral load to one of an inside diameter sidewall or an outer diameter sidewall of a lower portion of the ring-shaped body, and urging the lower portion of the ring-shaped body toward a rotating polishing pad.

BRIEF DESCRIPTION OF THE DRAWINGS

So that the manner in which the above-recited features of the present disclosure can be understood in detail, a more particular description of the disclosure may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other effective embodiments.

FIG. 3 is an isometric bottom view of the first support structure of one embodiment of a retaining ring as described herein.

FIG. 4 is a side cross-sectional view of the retaining ring along lines 4-4 of FIG. 3.

FIG. 5 is an enlarged partial sectional view of the retaining ring of FIG. 4.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

A retaining ring, and a method for conditioning and/or refurbishing a retaining ring, utilized for polishing a substrate are described herein. Apparatus for implementing the method includes a fixture assembly that is coupled to the retaining ring facilitating the conditioning and/or refurbishing.

Figure 1:
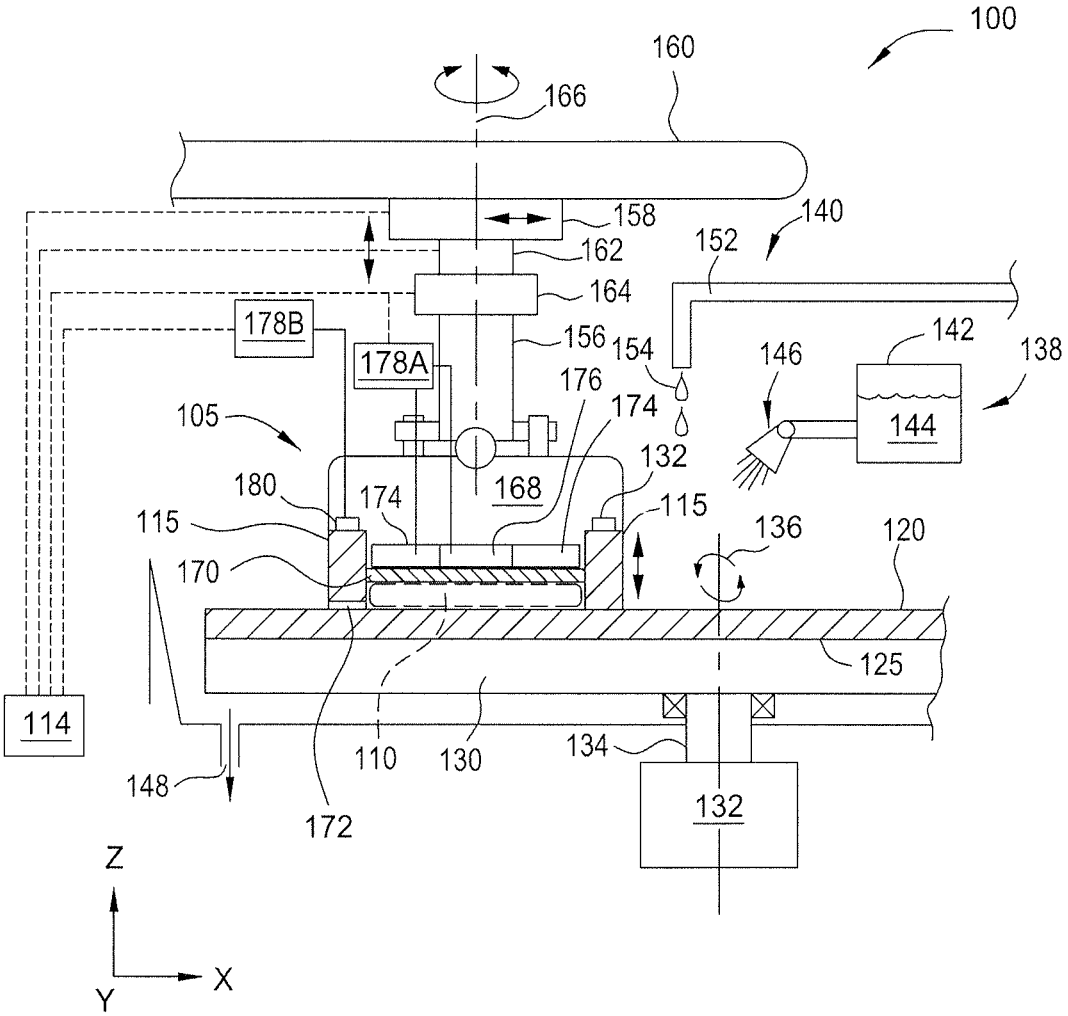
FIG. 1 is a partial cross-sectional view of a chemical mechanical polishing system.

FIG. 1 is a partial cross-sectional view of a chemical mechanical polishing (CMP) system 100. The CMP system 100 includes a carrier head 105 that holds a substrate 110 (shown in phantom) inside a retaining ring 115 and places the substrate 110 in contact with a polishing surface 120 of a polishing pad 125 during processing. The polishing pad 125 is deposed on a platen 130. The platen 130 may be coupled to a motor 132 by a platen shaft 134. The motor 132 rotates the platen 130 and hence, the polishing surface 120 of the polishing pad 125, about an axis 136 of the platen shaft 134 when the CMP system 100 is polishing the substrate 110.

The CMP system 100 may include a chemical delivery system 138 and a pad rinse system 140. The chemical delivery system 138 includes a chemical tank 142 which holds a polishing fluid 144, such as a slurry or deionized water. The polishing fluid 144 may be sprayed by a spray nozzle 146 onto the polishing surface 120. A drain 148 may collect the polishing fluid 144 which may flow off of the polishing pad 125. The polishing fluid 144 that is collected may be filtered to remove impurities, and transported back to the chemical tank 142 for reuse.

The pad rinse system 140 may include a nozzle 152 that delivers deionized water 154 to the polishing surface 120 of the polishing pad 125. The nozzle 152 is coupled to a deionized water tank (not shown). After polishing, the deionized water 154 from the nozzle 152 may rinse debris and excess polishing fluid 144 from the substrate 110, the carrier head 105 and the polishing surface 120. Although the pad rinse system 140 and the chemical delivery system 138 are depicted as separate elements, it should be understood that a single delivery tube may perform both functions of delivering the deionized water 154 delivery and the polishing fluid 144.

The carrier head 105 is coupled to a shaft 156. The shaft 156 is coupled to a motor 158, which may be coupled to an arm 160. The motor 158 may be utilized to move the carrier head 105 laterally in a linear motion (X and/or Y direction) relative to the arm 160. The carrier head 105 also includes an actuator 162 configured to move the carrier head 105 in a Z direction relative to arm 160 and/or the polishing pad 125. The carrier head 105 is also coupled to a rotary actuator or motor 164 that rotates the carrier head 105 about a centerline 166 (which may also be a rotational axis) relative to the arm 160. The motors 158, 164 and actuator 162 position and/or move the carrier head 105 relative to the polishing surface 120 of the polishing pad 125. In one embodiment, the motors 158, 164 rotate the carrier head 105 relative to the polishing surface 120 and provide a downforce to urge the substrate 110 against the polishing surface 120 of the polishing pad 125 during processing.

The carrier head 105 includes a body 168 which houses a flexible membrane 170. The flexible membrane 170 provides a surface on the underside of the carrier head 105 that contacts the substrate 110. The body 168 and the flexible membrane 170 are circumscribed by the retaining ring 115. The retaining ring 115 may have a plurality of grooves 172 (one is shown) that facilitates slurry transportation.

The carrier head 105 may also contain one or more bladders, such as an outer bladder 174 and an inner bladder 176, that are adjacent to the flexible membrane 170. As discussed above, the flexible membrane 170 contacts a backside of the substrate 110 when the substrate 110 is retained in the carrier head 105. The bladders 174, 176 are coupled to a first variable pressure source 178A that selectively delivers a fluid to the bladders 174, 176 to apply force to the flexible membrane 170. In one embodiment, the bladder 174 applies force to an outer zone of the flexible membrane 170 while the bladder 176 applies force to a central zone of the flexible membrane 170. Forces applied to the flexible membrane 170 from the bladders 174, 176 are transmitted to portions of the substrate 110 and may be used to control the edge to center pressure profile that is translated to the substrate 110 and against the polishing surface 120 of the polishing pad 125. The first variable pressure source 178A is configured to deliver fluids to each of the bladders 174, 176 independently in order to control forces through the flexible membrane 170 to discrete regions of the substrate 110. Additionally, vacuum ports (not shown) may be provided in the carrier head 105 to apply suction to the backside of the substrate 110 facilitating retention of the substrate 110 in the carrier head 105. Examples of a carrier head 105 that may be adapted to benefit from the disclosure include the TITAN HEAD™, the TITAN CONTOUR™ and the TITAN PROFILER™ carrier heads, which are available from Applied Materials, Inc. of Santa Clara, Calif., among other carrier heads available from other manufacturers.

In one embodiment, the retaining ring 115 is coupled to the body 168 by an actuator 180. The actuator 180 is controlled by a second variable pressure source 178B. The second variable pressure source 178B provides or removes fluid from the actuator 180 which causes the retaining ring 115 to move relative to the body 168 of the carrier head 105 in the Z direction. The second variable pressure source 178B is adapted to provide the Z directional movement of the retaining ring 115 independent of movement provided by the motor 162. The second variable pressure source 178B may provide movement of the retaining ring 115 by applying negative pressure or positive pressure to the actuator 180 and/or the retaining ring 115. In one aspect, pressure is applied to the retaining ring 115 to urge the retaining ring 115 toward the polishing surface 120 of the polishing pad 125 during a polishing process.

As discussed above, the retaining ring 115 may contact the polishing surface 120 during polishing of the substrate 110. The chemical delivery system 138 may deliver polishing fluid 144 to the polishing surface 120 and substrate 110 during polishing. Grooves 172 formed in the retaining ring 115 facilitate transportation of the polishing fluid 144 and entrained polishing debris through the retaining ring 115 and away from the substrate 110. After processing a substrate 110, the substrate 110 may be removed from the carrier head 105.

Figure 2:
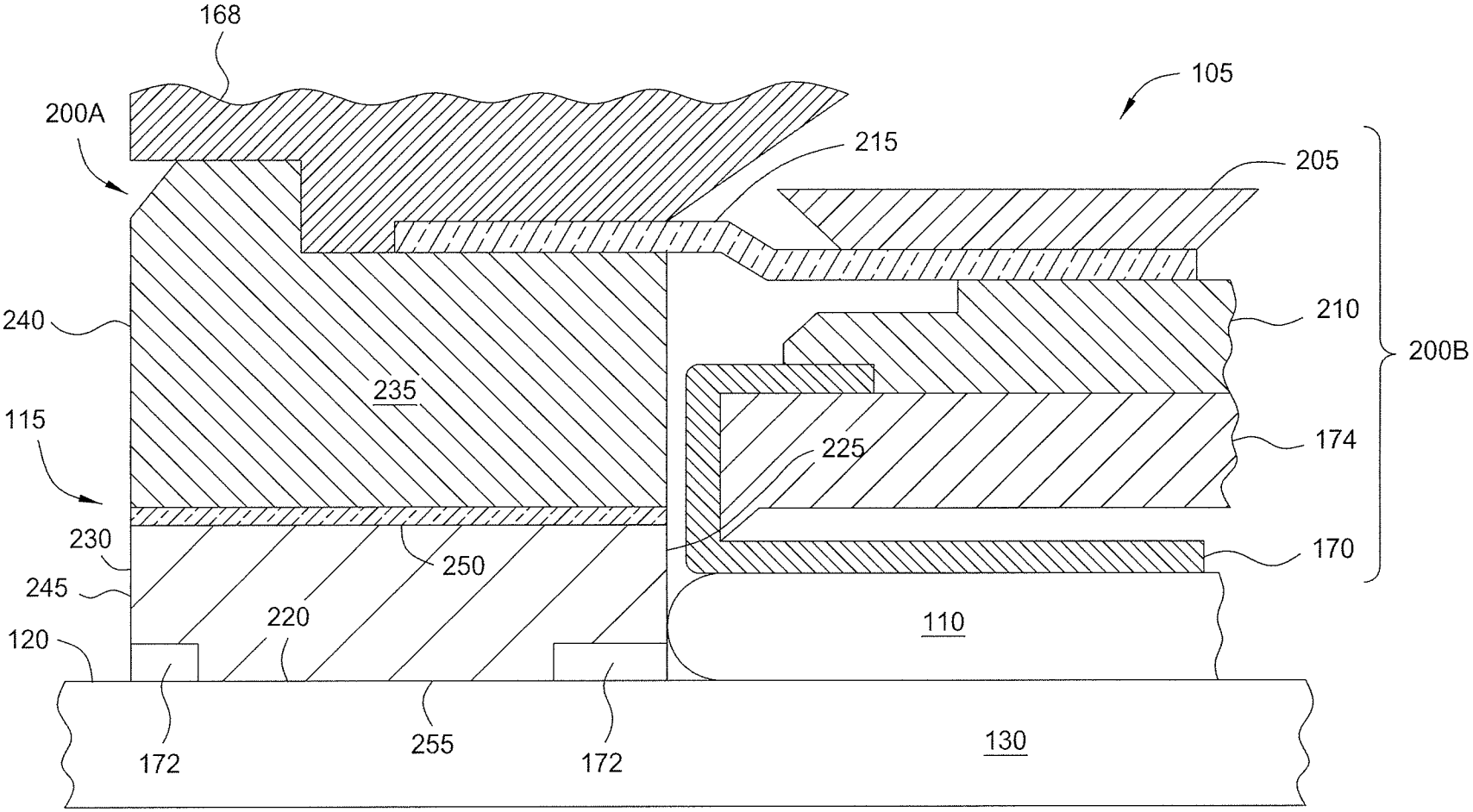
FIG. 2 is a cross-sectional view for a portion of the carrier head and the retaining ring of FIG. 1.

FIG. 2 is a cross-sectional view for a portion of the carrier head 105 and the retaining ring 115 of FIG. 1. The carrier head 105 may include a first support structure 200A and a second support structure 200B. The second support structure 200B may be used to urge the substrate 110 against the polishing pad 125 while the first support structure 200A retains the substrate within the carrier head 105. The second support structure 200B may have an upper clamp 205 and a lower clamp 210 for fastening the second support structure 200B to a flexure diaphragm 215 attached to the body 168 of the carrier head 105. This arrangement allows for vertical movement in the second support structure 200B while polishing the substrate 110. The bottom surface of the lower clamp 210 is coupled to the bladder 174 and the flexible membrane 170, which move in unison as part of the second support structure 200B.

The retaining ring 115 may be ring shaped and include a center line that shares the center line 166 of the carrier head 105 illustrated in FIG. 1. The first support structure 200A of the carrier head 105 may also include the retaining ring 115 having a bottom surface 220, an inside diameter sidewall 225 and an outer diameter sidewall 230. The retaining ring 115 may consist of a body 235 that may be formed from a single mass of material. Alternately, the body 235 may be formed from two or more portions. The portions of the body 235 may include one or more pieces which fit together to form the ring shape of body 235. In one embodiment, the body 235 of the retaining ring 115 is of a single unitary construction. In another embodiment, the body 235 of the retaining ring 115 is formed from two or more ring-shaped portions. For example, the retaining ring 115 may have an upper portion 240 attached to a lower portion 245. An adhesive layer 250 may be used to bond the upper portion 240 of the retaining ring 115 to the lower portion 245 of the retaining ring 115. The adhesive layer 250 may be an epoxy material, a urethane material, or an acrylic material.

The body 235, or at least the upper portion 240, may be formed from a metallic material, such as stainless steel, aluminum, molybdenum, or another process-resistant metal or alloy, or a ceramic or a ceramic filled polymer plastic, or a combination of these or other suitable materials. In one example, the upper portion 240 of the body 235 may be formed from a metal, such as stainless steel. Additionally, the body 235, or at least the lower portion 245, may be fabricated from a plastic material such as polyphenylene sulfide (PPS), polyethylene terephthalate, polyetheretherketone, polybutylene terephthalate, polybutylene naphthalate, ERTALYTE® TX, PEEK, TORLON®, DELRIN®, PET, VESPEL®, DURATROL®, or a combination of these or other suitable materials. In one example, the lower portion 245 of the body 235 may be fabricated from a ceramic material. In one embodiment, the upper portion 240 provides rigidity while the lower portion 245 provides a sacrificial surface 255 that contacts the polishing surface 120 of the polishing pad 125. The sacrificial surface 255 tends to wear during polishing processes and must be replaced after numerous cycles.

As described above, conventional retaining rings are manufactured using conventional CNC machining methods. The surface finish (average surface roughness (Ra)) and flatness achieved by these methods is typically about 16 Ra and 0.001 inches, respectively. The machine tolerance and finish at these levels do not yield a production worthy part as the as-machined retaining rings generate an unacceptable amount of particles during polishing. Furthermore, conventional retaining rings with a generally flat (0.001-inch) profile has been shown to inadequately control the polishing pad surface topology thus requiring an extensive break-in process prior to use in production.

It has been found that optimal polishing is achieved using a retaining ring 115 with a negative taper on the sacrificial surface 255 (i.e., where a thickness of the inside diameter sidewall 225 of the retaining ring 115 is slightly thinner than a thickness of the outer diameter sidewall 230). Additionally, it has been found that altering the roughness of the sacrificial surface 255 of the retaining ring 115 to a roughness much less than about 16 Ra reduces particles as well as enhances polishing.

FIG. 3 is an isometric bottom view of the first support structure 200A of one embodiment of a retaining ring 115 as described herein. The sacrificial surface 255, having grooves 172 formed therein, is coupled to the body 235. The body 235 may include an inside dimension 300 (e.g., a diameter) of about 11 inches to about 12 inches and an outside dimension 305 (e.g., a diameter) of about 12 inches to about 13.5 inches. A plurality of holes 310 are also formed through the body 235 for facilitating attachment to a carrier head 105 (shown in FIGS. 1 and 2).

FIG. 4 is a side cross-sectional view of the retaining ring 115 along lines 4-4 of FIG. 3. The lower portion 245 is coupled to the upper portion 240. The lower portion 245 also includes the sacrificial surface 255 which includes a conical taper 400. In some embodiments, the conical taper 400 is about 175 degrees to about 185 degrees.

FIG. 5 is an enlarged partial sectional view of the retaining ring 115 of FIG. 4. The sacrificial surface 255 of the lower portion 245 of the retaining ring 115 includes a negative tapered surface 500. The negative tapered surface 500 is defined by a difference in a thickness T' of the inside diameter sidewall 225 and a thickness T" of the outer diameter sidewall 230. The difference between the thickness T' and the thickness T" may be defined by a taper height 505 that may be about 0.0003 inches to about 0.00015 inches, such as about 0.0002 inches. In some embodiments, the negative tapered surface 500 may include a flatness less than 0.002 inches and a mirror finish (i.e., about 4 micro-inches to about 5 micro-inches RMS).

Methods and Apparatus for Forming Retaining Rings

Figure 6:
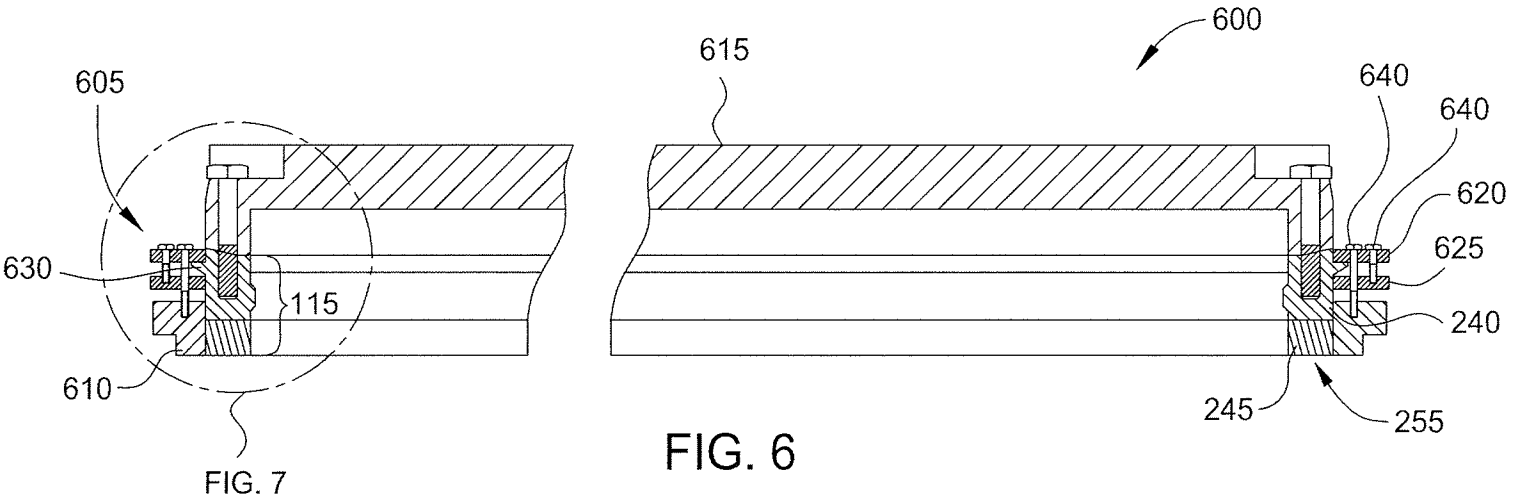
FIG. 6 is a side cross-sectional view of one embodiment of a fixture for producing the negative tapered surface on the lower portion of the retaining ring.

FIG. 6 is a side cross-sectional view of one embodiment of a fixture 600 for producing the negative tapered surface 500 on the sacrificial surface 255 of the lower portion 245 of the retaining ring 115. The fixture 600 may be placed on a polishing module (not shown) when the retaining ring 115 is coupled thereon in order to form the negative tapered surface 500. As will be explained in greater detail below in reference to FIG. 11, a polishing process, using a polishing pad, is performed to form the negative tapered surface 500.

Figure 7:
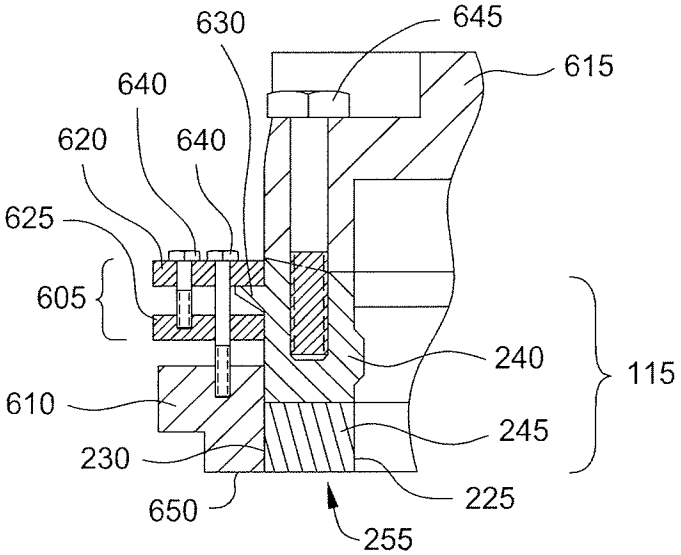
FIG. 7 is an enlarged partial sectional view of the fixture shown in FIG. 6.

FIG. 7 is an enlarged partial sectional view of the fixture 600 shown in FIG. 6. The fixture 600 includes a clamp device 605, an outer clamp ring 610 and a fixture plate 615. The outer clamp ring 610 may include an inside dimension that snugly receives the outer diameter sidewall 230 of the lower portion 245. The clamp device 605 and the fixture plate 615 may be made from a metallic material such as aluminum or stainless steel. In one embodiment, the clamp device 605 comprises an external clamp device that controls lateral loading on the lower portion 245 of the retaining ring 115. The outer clamp ring 610 may be made of a polyether ether ketone material or an equivalent durable plastic material. The outer clamp ring 610 may reduce the polishing rate of the outer diameter sidewall 230 of the lower portion 245 of the retaining ring 115 by supporting the outer diameter sidewall 230. This provides additional control over the polishing rate of the inside diameter sidewall 225 versus the outer diameter sidewall 230. Furthermore the presence of this outer clamp ring 610 can control formation of a fillet at the edge of the outer diameter sidewall 230.

The clamp device 605 may include two annular rings 620 and 625 that are fastened to each other and/or to the outer clamp ring 610 using fasteners 640. One of the fasteners may be an adjustment fastener while the other fastener may be a locking fastener. Another plurality of fasteners 645 may be used to couple the fixture plate 615 to the upper portion 240 of the retaining ring 115. The clamp device 605, specifically the annular ring 625, may rest on a shoulder 630 extending radially outward from the outer surface of the upper portion 240. Tightening of the fasteners 640 and the fasteners 645 facilitates the coupling of the fixture plate 615 and the outer clamp ring 610 such that the fixture 600 is integral with the retaining ring 115. Utilization of the outer clamp ring 610 keeps the lower portion 245 of the retaining ring 115 square with respect to a surface of a polishing pad (not shown) while forming the negative tapered surface 500. Adjustment of a lower surface 650 of the outer clamp ring 610 relative to the sacrificial surface 255 controls rebound of the polishing pad during the polishing process and influences taper of the sacrificial surface 255 and/or the outer diameter sidewall 230 of the lower portion 245 of the retaining ring 115. The fixture 600 may comprise an outer diameter fixture that is utilized to apply a controlled lateral load on the outer diameter sidewall 230 of the lower portion 245 of the retaining ring 115. The outer clamp ring 610 may be further utilized to maintain a fixed boundary on the outer diameter sidewall 230 of the lower portion 245 of the retaining ring 115. In the absence of a fixed boundary on the outer diameter sidewall 230 of the lower portion 245, lateral forces applied to the inner diameter sidewall 225 may adversely displace and enlarge the outer diameter of the lower portion 245 rather than inducing material deformation toward the lower surface 650 of the outer clamp ring 610.

Figure 8:
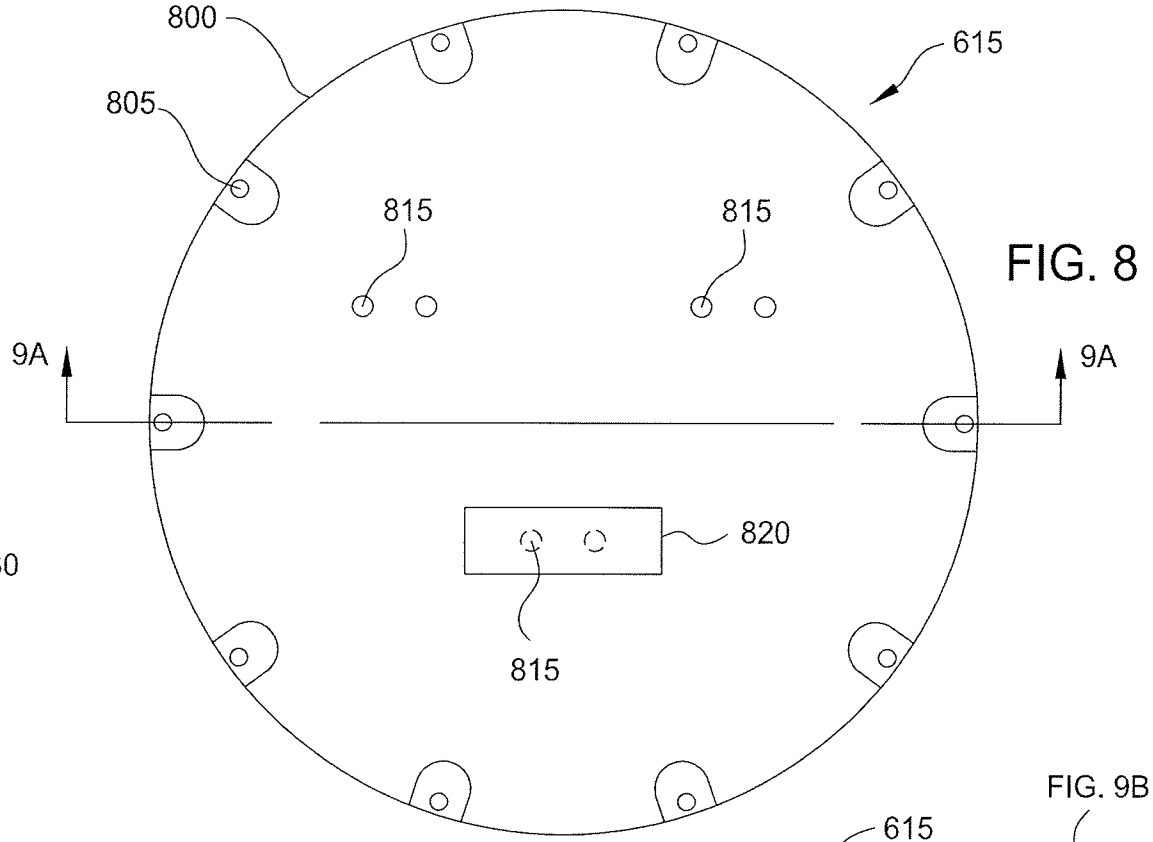
FIG. 8 is a top plan view of the fixture plate of the fixture of FIGS. 6 and 7.

FIG. 8 is a top plan view of the fixture plate 615 of the fixture 600 of FIGS. 6 and 7. The fixture plate 615 may include a circular body 800 having a plurality of openings 805 formed therein for receiving the fasteners 645 shown in FIGS. 6 and 7. Each of the openings 805 may be provided in the same number and/or at the same locations as the holes 310 of the upper portion 240 of the retaining ring 115 shown in FIG. 3. Additionally, the circular body 800 may include attachment features 815 for attaching weights 820 (only one is shown) to an upper surface thereof. The weights 820 may be used to adjust downforce applied to the fixture 600 and the retaining ring 115 during the polishing process. The circular body 800 may be made from a metallic material, such as aluminum or stainless steel.

Figure 9A:
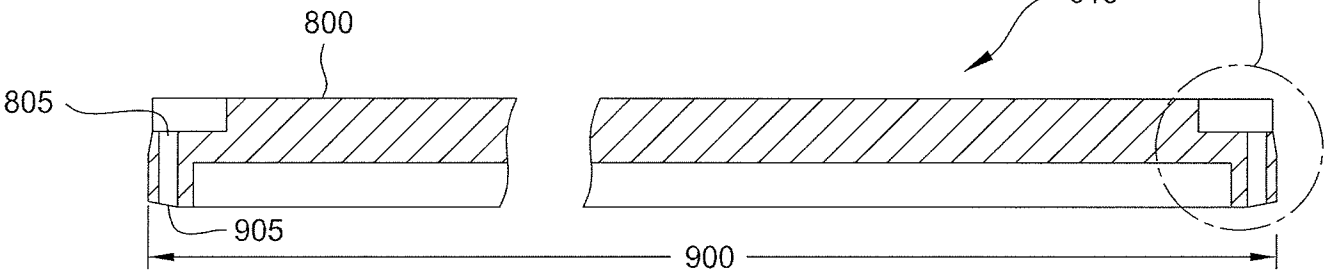
FIG. 9A is a side cross-sectional view of the fixture plate of FIG. 8.

FIG. 9A is a side cross-sectional view of the fixture plate 615 of FIG. 8. The circular body 800 may include an outside diameter 900 that is substantially the same as the outside dimension 305 of the body 235 of the retaining ring 115 shown in FIG. 3 (e.g., +1-0.03 inches, or less). In some embodiments, the fixture plate 615 includes a profiled surface 905 that contacts the upper portion 240 of the retaining ring 115 (shown in FIGS. 6 and 7). The profiled surface 905 may include a positive taper that deforms the lower portion 245 during conditioning in order to yield the negative tapered surface 500 of the lower portion 245 of the retaining ring 115 (shown in FIG. 5).

Figure 9B:
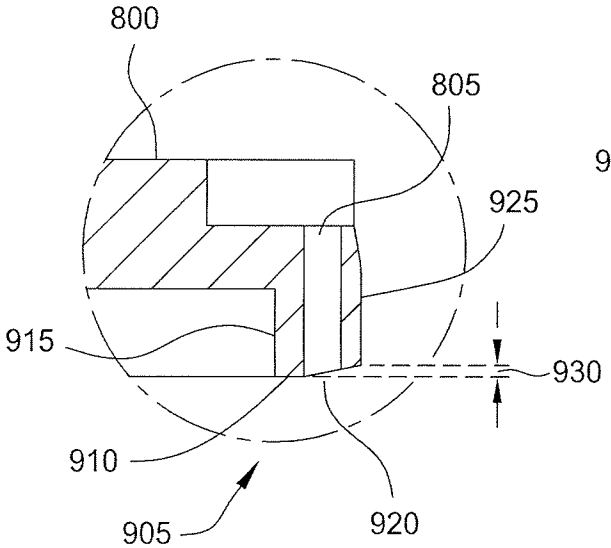
FIG. 9B is an enlarged partial cross-sectional view of the fixture plate of FIG. 9A.

FIG. 9B is an enlarged partial cross-sectional view of the fixture plate 615 of FIG. 9A. In some embodiments, the profiled surface 905 may include a flat portion 910 adjacent an inside diameter surface 915 of the circular body 800. A tapered portion, in the form of a positive taper 920, may be adjacent an outer diameter surface 925 of the circular body 800. The positive taper 920 of the fixture plate 615 may be defined as the ID is thicker than the OD. The positive taper 920 may be defined by an offset dimension 930 that is about 0.007 inches to about 0.003 inches, in one embodiment. In one example, the offset dimension 930 is about 0.005 inches.

Figure 9C:
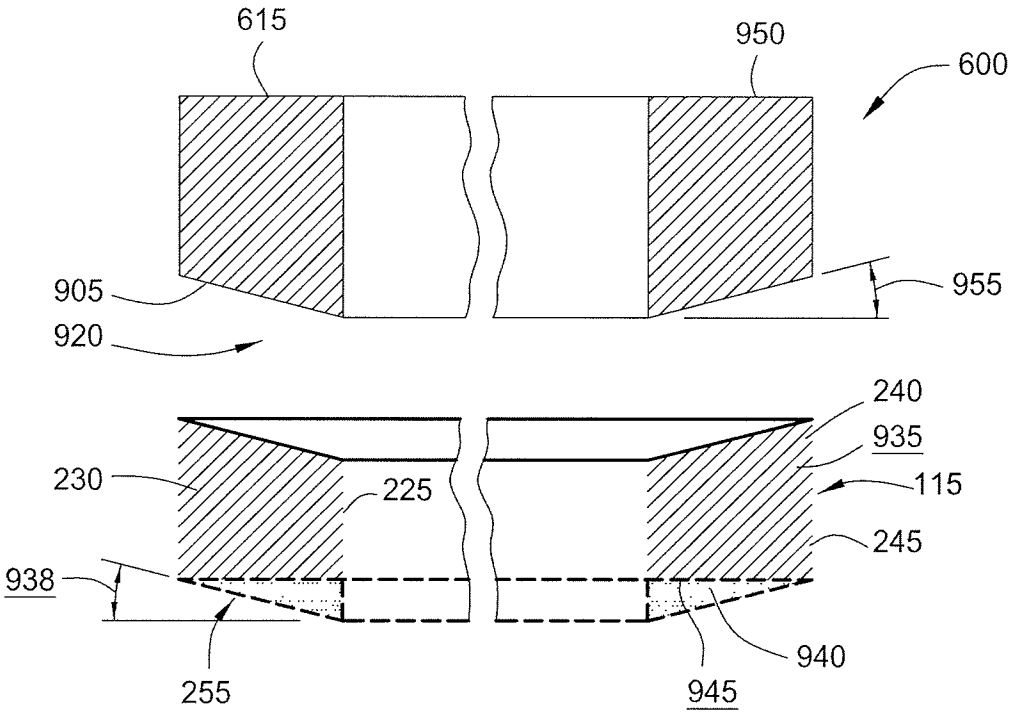
FIGS. 9C and 9D are schematic representations showing the process of forming the negative tapered surface on a retaining ring.
Figure 9D:
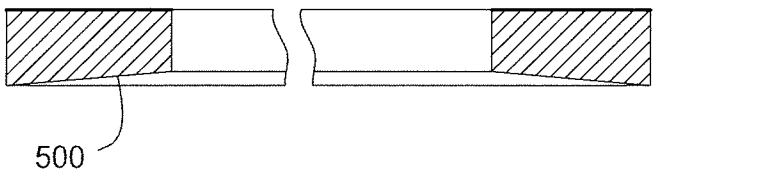

FIGS. 9C and 9D are schematic representations showing the process of forming the negative tapered surface 500 on a retaining ring 115. As shown in FIG. 9C, the retaining ring 115 (when mounted to the fixture plate 615) is processed as a deformed ring 935. In other words, the retaining ring 115 is processed in a deformed state (causing the sacrificial surface 255 to have a positive taper angle 938). The processing of the deformed ring 935 when attached to the fixture plate 615 removes sacrificial material 940 from the portion of the deformed ring 935 in contact with a polishing surface of a polishing pad (not shown). The polishing process transforms the positive taper angle 938 to a flat or planar surface 945 before removal of the deformed ring 935 from the fixture plate 615. The planar surface 945 may be substantially parallel to a surface 950 of the fixture plate 615 opposing the profiled surface 905. In another aspect, a taper angle 955 of the fixture plate 615 may be substantially equal to the positive taper angle 938 of the deformed ring 935.

After processing and removal of the deformed ring 935 from the fixture plate 615, the retaining ring 115 relaxes into a neutral state (sacrificial surface 255 has the negative tapered surface 500) as shown in FIG. 9D. In one embodiment, the taper angle 955 of the fixture plate 615 is opposite to the desired negative tapered surface 500 of the retaining ring 115. In one aspect, the angle 955 of the positive taper on the fixture plate 615 produces the negative tapered surface 500 on the retaining ring 115.

One theory of operation is, by mounting a retaining ring 115 to the rigid fixture plate 615, and applying a downforce (e.g., about 36-in/lb) using fasteners 645, induces a positive taper angle 938 at the sacrificial surface 255 of the lower portion 245 of the retaining ring 115 that is proportional to the positive taper 920 of the fixture plate 615. The induced positive taper angle 938 is characterized by a uniform displacement of the inside diameter sidewall 225 (e.g., a displacement of approximately 0.001-inch) relative to the plane defined by the outer diameter sidewall 230 of the lower portion 245 of the retaining ring 115. Note that the positive taper 920 can be modified in order to influence the magnitude of the positive taper angle 938. For example, a greater positive taper 920 on the fixture plate 615 would yield a greater positive taper angle 938 on the retaining ring 115 prior to conditioning. The displacement of the inside diameter sidewall 225 reduces to approximately zero during conditioning due to asymmetric material removal from the bottom surface 220. The retaining ring 115 relaxes to neutral state after removing fasteners 645 thus achieving a finished state with a negative taper surface 500.

Figure 10:
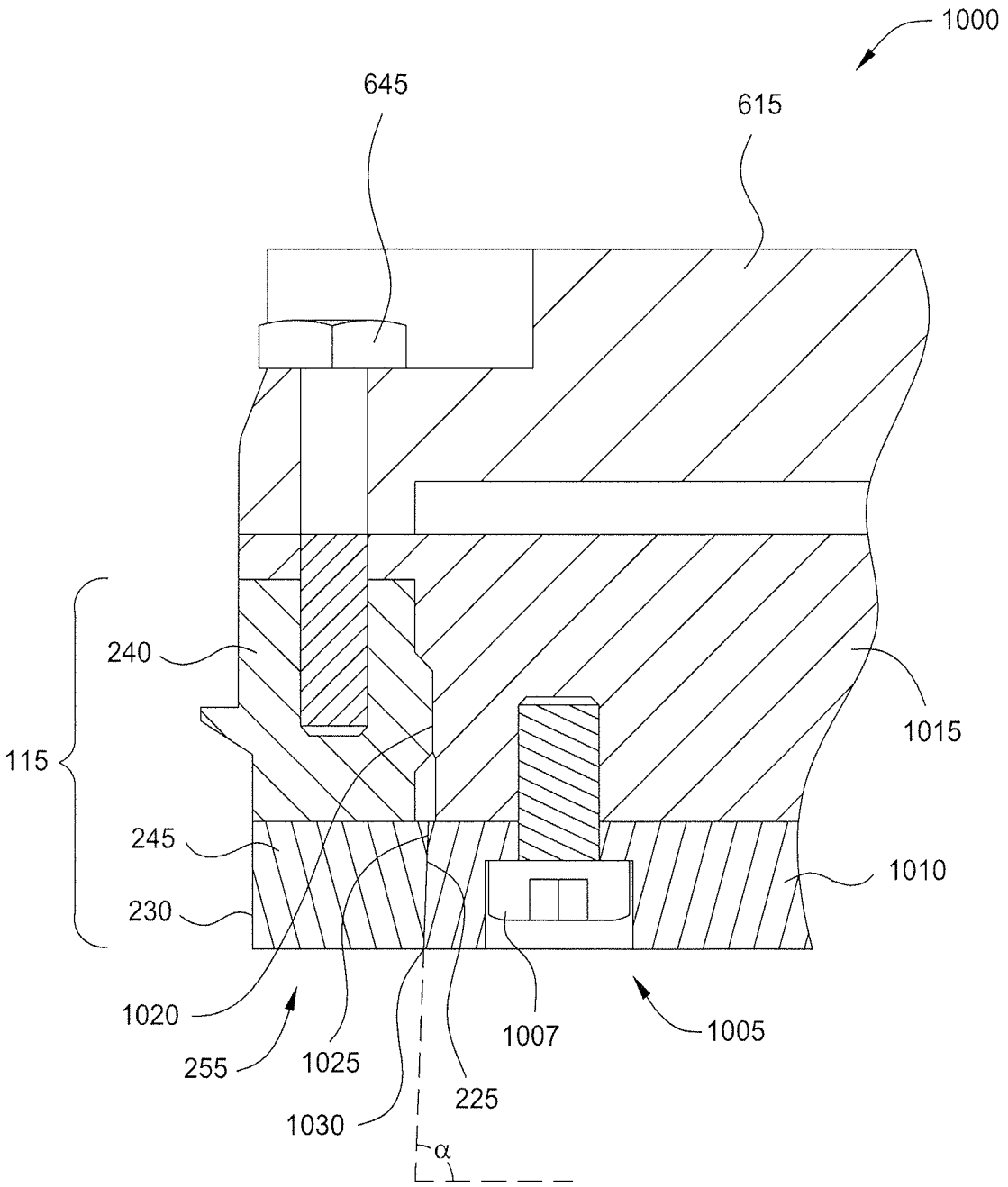
FIG. 10 is a partial side cross-sectional view of another embodiment of a fixture for producing the negative tapered surface on the lower portion of the retaining ring.

FIG. 10 is a partial side cross-sectional view of another embodiment of a fixture 1000 for producing the negative tapered surface 500 on the sacrificial surface 255 of the lower portion 245 of the retaining ring 115. The fixture 1000 may be substantially the same as the fixture 600 of FIGS. 6 and 7 with the following exceptions. While the fixture 600 is utilized to couple to the outer diameter sidewall 230 of the lower portion 245 of the retaining ring 115, the fixture 1000 is utilized to couple to the inside diameter sidewall 225 of the lower portion 245 of the retaining ring 115.

The fixture 1000 may comprise an internal interference fit swage fixture that is utilized to apply a controlled lateral load on the inside diameter sidewall 225 of the lower portion 245 of the retaining ring 115. The fixture plate 615 utilized in the fixture 600 may also be used with the fixture 1000. However, a clamping device 1005 is an internal clamping device in this embodiment. The clamping device 1005 includes a plurality of fasteners 1007 (only one is shown in the partial cross-sectional view of FIG. 10). Each fastener 1007 is disposed in a hole formed through a mandrel 1010 that fits snugly within the inside diameter sidewall 225 of the lower portion 245 of the retaining ring 115. A swage adapter 1015 is disposed adjacent the mandrel 1010 and the fastener 1007 couples the mandrel 1010 to the swage adapter 1015. The swage adapter 1015 may interface with a shoulder 1020 formed on an inside surface of the upper portion 240 of the retaining ring 115. The fastener 645 may be used to attach the fixture plate 615 and the swage adapter 1015 to the retaining ring 115. In some embodiments, an outer peripheral surface 1025 of the mandrel 1010 may include an angle $\alpha$ that is less than about 90 degrees. In one embodiment, the angle $\alpha$ is about 89 degrees to about 85 degrees, or less. A peripheral lower surface 1030 of the mandrel 1010 may be about 0.002 inches to about 0.004 inches greater than the diameter measured between the inside diameter sidewall 225 of the lower portion 245 of the retaining ring 115. The greater dimension provides an interference fit and may serve to splay the lower portion 245 of the retaining ring 115 radially outward. The mandrel 1010 is press-fit into the inside diameter sidewall 225 which reams the inside diameter sidewall 225 and splays the lower portion 245 of the retaining ring 115 in order to achieve a uniform displacement of the inside diameter sidewall 225 (e.g., approximately 0.001-inch).

Figure 11:
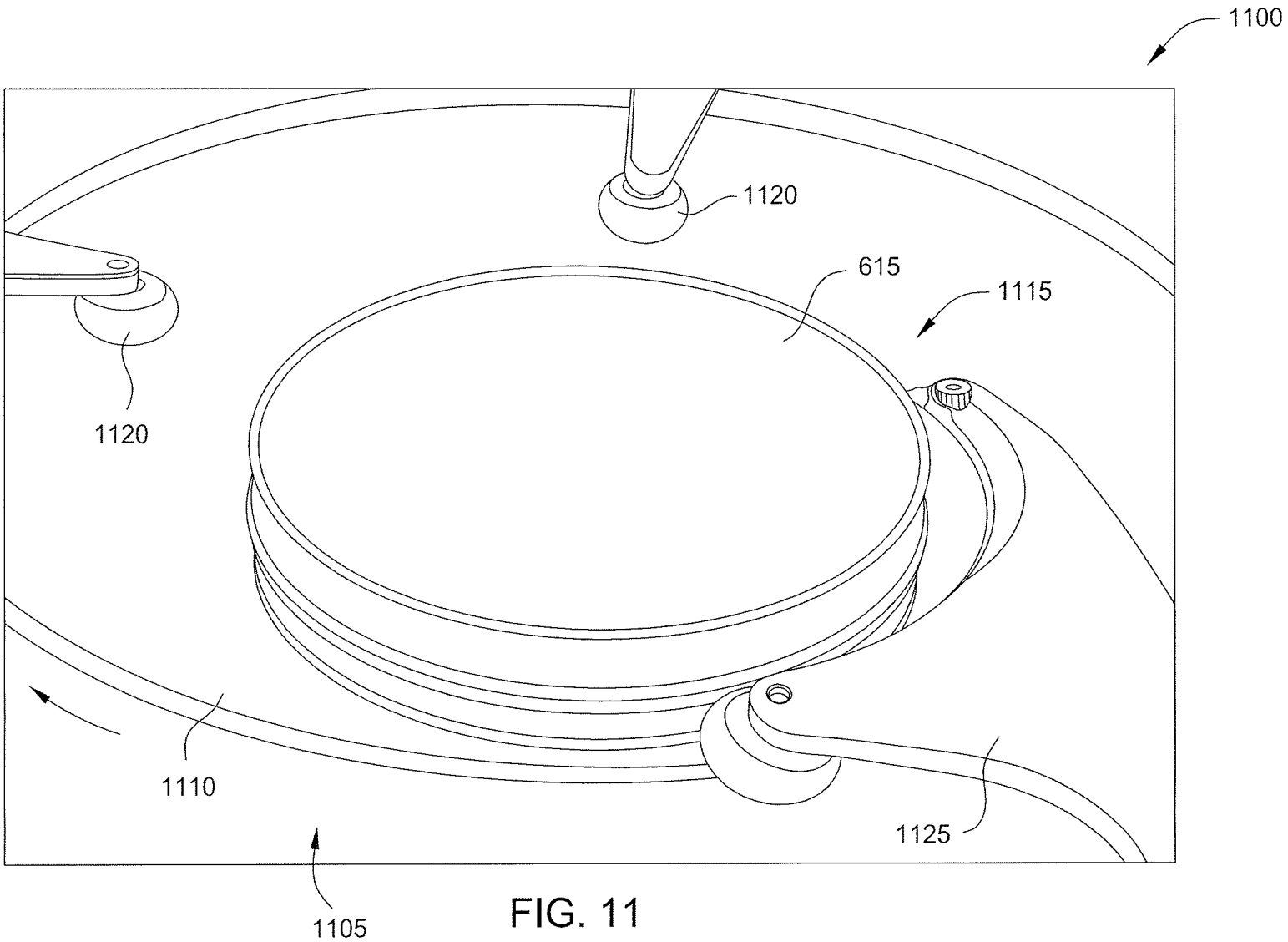
FIG. 11 is a schematic perspective view of one embodiment of a conditioning system.

FIG. 11 is a schematic perspective view of one embodiment of a conditioning system 1100 for producing the negative tapered surface 500 on a retaining ring as described herein. The conditioning system 1100 includes a platen 1105 having a polishing pad 1110 rotatably disposed thereon. The polishing pad 1110 may be a polishing pad comprising a polymeric material that is typically utilized in polishing semiconductor substrates. A fixture 1115, such as the fixture 600 or the fixture 1000 (coupled to a retaining ring (not shown)) as described herein is placed on the polishing pad 1110 with the sacrificial surface 255 (shown in FIGS. 6, 7 and 10) facing the polishing pad 1110. Retaining members, such as wheels 1120 and/or a yoke 1125, may be utilized to hold the fixture 1115 onto the polishing pad 1110 during rotation of the platen 1105. The centerline of the fixture 1115 is offset from the rotational axis (which is the same as axis 136 shown in FIG. 1) of the platen 1105. The fixture 1115 rotation is induced by rotation of the platen 1105 during conditioning. The fixture 1115 rotation speed may be proportional to the platen 1115 rotation speed.

Conditioning Method

A conditioning method for producing a retaining ring 115 having a negative tapered surface 500 will be described. The conditioning method utilizes a stand-alone conditioning system 1100 such that CMP tools for polishing production substrates may remain on-line. The conditioning system 1100 mimics a full scale CMP system but at dramatically lower cost. Once the fixture 1115 is positioned such that the sacrificial surface 255 faces the polishing pad 1110, the platen 1105 may be rotated at about 65 rpm for about 15-30 minutes or until a mirror finish is achieved on the sacrificial surface 255. A slurry, such as a commercially available CMP slurry, may be dispersed at the center of the polishing pad 1110 at a rate of about 65 milliliters per minute during conditioning of the retaining ring 115. After conditioning, the retaining ring 115 may be disassembled from the fixture 1115 and then the profile of the negative tapered surface 500 may be verified by laser and coordinate measuring methods, for example. In order to refurbish a used retaining ring 115 that no longer conforms to taper specifications due to sacrificial surface consumption, the worn sacrificial surface 255 may be removed by a lathe such that the entire lower portion 245 of the retaining ring 115 is removed. The upper portion 240 of the retaining ring 115 may further be machined to expose virgin material of the upper portion 240. A new lower portion 245 may then be adhered to the upper portion 240 and the retaining ring 115 having the new lower portion 245 may be coupled to the fixture 1115 as described above. The conditioning regime described above may then be performed on the conditioning system 1100 to produce the negative tapered surface 500 as previously described. Alternatively, to refurbish a retaining ring 115 without replacing the whole lower portion 245, the worn sacrificial surface 255 may be reconditioned via lathe removal of 0.01 inches to 0.08 inches from the bottom surface 220. The retaining ring 115 then having a flat bottom surface (e.g., sacrificial surface 255) may be coupled to the fixture 1115 and the conditioning regime described above then performed on the conditioning system 1100 to produce the negatively tapered surface 500 as previously described.

While the foregoing is directed to embodiments of the disclosure, other and further embodiments of the disclosure may be devised without departing from the basic scope thereof.

What is claimed is:

1. A retaining ring for a polishing process, the retaining ring comprising:

a ring shaped body comprising an upper portion having a top surface and a lower portion contacting the upper portion at an interface, the upper portion having a plurality of holes formed therethrough in a depth direction thereof;

an inner shoulder formed on an inside surface of the upper portion, the inside surface comprising a sidewall section extending from the top surface to the inner shoulder; and a sacrificial surface disposed on the lower portion, the sacrificial surface comprises a negative tapered angle relative to an axis parallel to a first plane of the upper portion, wherein the lower portion comprises an inner circumferential sidewall surface and an outer circumferential sidewall surface, wherein the outer circumferential sidewall surface extends from the interface to the sacrificial surface, the outer circumferential sidewall surface having a uniform radius relative to a center of the retaining ring, wherein an inner height of the inner circumferential sidewall surface is shorter than an outer height of the outer circumferential sidewall surface, wherein the inner shoulder is disposed radially inward relative to the inner circumferential sidewall surface of the lower portion and the sidewall section of the inside surface.

2. The retaining ring of claim 1, wherein the lower portion of the ring-shaped body is fabricated from a plastic material.

3. The retaining ring of claim 1, wherein a bottom surface of the ring shaped body comprises a plurality of grooves.

4. The retaining ring of claim 3, wherein the bottom surface comprises a mirror finish.

5. The retaining ring of claim 1, wherein the sacrificial surface has a flatness of less than 0.002 inches.

6. The retaining ring of claim 1, wherein the sacrificial surface has a mirror-polished surface of 4 micro-inches to 5 micro-inches (RMS).

7. The retaining ring of claim 1, wherein the upper portion is fabricated from a metal and the lower portion is fabricated from a plastic.

8. The retaining ring of claim 1, wherein the sacrificial surface has a taper height of 0.0003 inches to 0.00015 inches.

9. The retaining ring of claim 1, wherein the sacrificial surface is planar and extends from the inner circumferential sidewall surface to the outer circumferential side-wall surface.

10. A retaining ring for a polishing process, the retaining ring comprising:

a ring shaped body comprising an upper portion and a lower portion, the upper portion having a plurality of holes formed therethrough for attachment to a fixture plate during formation and a carrier head during use in a polishing process, the upper portion having, a planar surface disposed in a first plane;

an inner shoulder formed on an inside surface of the upper portion, the inside surface comprising a sidewall section extending from the planar surface to the inner shoulder, wherein the inner shoulder is disposed radially inward relative to an inner circumferential sidewall surface of the lower portion and the sidewall section of the inside surface;

an outer shoulder extending radially outward from an outer surface of the upper portion, the outer shoulder having a surface substantially parallel to the first plane; and a sacrificial surface disposed on the lower portion, the sacrificial surface disposed in a second plane that is negatively angled relative to an axis parallel to the first plane and having a taper height that is 0.0003 inches to 0.00015 inches, and the sacrificial surface includes a roughness less than 16 Ra, wherein the lower portion of the retaining ring interfaces the upper portion at a first interface and a second interface, wherein the first and second interfaces are on different planes.

11. The retaining ring of claim 10, wherein the lower portion of the ring-shaped body is fabricated from a plastic material.

12. The retaining ring of claim 10, wherein a bottom surface of the ring shaped body comprises a plurality of grooves.

13. The retaining ring of claim 12, wherein the bottom surface comprises a mirror-polished surface.

14. The retaining ring of claim 10, wherein the upper portion is fabricated from a metal and the lower portion is fabricated from a plastic.

15. The retaining ring of claim 11, wherein the plastic material comprises a plurality of grooves.

* * * * *